United States Patent [19]

Sakurai

[11] Patent Number: 4,752,183

[45] Date of Patent: Jun. 21, 1988

[54] WATER PUMP

[75] Inventor: Junichiro Sakurai, Toyota, Japan

[73] Assignee: Aisin Seiki Kabushiki Kaisha, Kariya, Japan

[21] Appl. No.: 31,614

[22] Filed: Mar. 30, 1987

[30] Foreign Application Priority Data

Mar. 31, 1986 [JP] Japan ..... 61-073705

[51] Int. Cl.[4] ..... F04D 17/00

[52] U.S. Cl. ..... 415/12; 415/48; 415/131; 415/157; 416/39; 416/133

[58] Field of Search ..... 416/39, 133, 186 A; 415/12, 48, 131, 132, 157–158, 47

[56] References Cited

U.S. PATENT DOCUMENTS

| | | | |
|---|---|---|---|
| 2,005,193 | 6/1935 | Mayo | 415/12 |
| 2,047,028 | 7/1936 | Metcalfe | 416/39 X |
| 2,075,498 | 3/1937 | Bondurant | 415/48 X |
| 2,114,567 | 4/1938 | Mercur | 415/12 |
| 2,353,871 | 7/1944 | Bowen | 415/131 |
| 2,358,744 | 9/1944 | Stepanoff | 415/131 X |
| 2,927,536 | 3/1960 | Rhoades | 415/48 |
| 2,957,424 | 10/1960 | Brundage et al. | 415/48 |
| 3,407,740 | 10/1968 | Samerdyke | 415/131 |
| 3,591,079 | 7/1971 | Peters | 415/12 X |
| 3,806,278 | 4/1974 | Grennan | 416/133 X |
| 3,918,831 | 11/1975 | Grennan | 415/131 |
| 4,070,132 | 1/1978 | Lynch | 415/131 X |
| 4,213,735 | 7/1980 | Grennan | 415/131 |
| 4,417,849 | 11/1983 | Morris | 415/131 |

FOREIGN PATENT DOCUMENTS

| | | | |
|---|---|---|---|
| 2126130 | 12/1972 | Fed. Rep. of Germany | 415/48 |
| 2260678 | 6/1974 | Fed. Rep. of Germany | 415/12 |
| 2102885 | 2/1983 | United Kingdom | 416/39 |
| 361312 | 1/1973 | U.S.S.R. | 415/131 |
| 387143 | 10/1973 | U.S.S.R. | 415/131 |
| 1016560 | 5/1983 | U.S.S.R. | 415/131 |

*Primary Examiner*—Everette A. Powell, Jr.
*Attorney, Agent, or Firm*—Oblon, Fisher, Spivak, McClelland & Maier

[57] ABSTRACT

A water pump having a pump impeller and a cup-like disk disposed to be movable along a rotation shaft driven by the engine, a space for passing water being formed between the pump impeller and the cup-like disk, the pump impeller and the cup-like disk being engaged each other by the engagement of vanes and grooves formed at least one side of them respectively, the distance between the pump impeller and the cup-like disk being varied according to the change of water temperature or the change of rotation speed of the engine, thereby to make it possible to adjust the water flow rate of the pump.

1 Claim, 5 Drawing Sheets

WATER PUMP

BACKGROUND OF THE INVENTION

1. Field of the Invention

This invention relates to a water pump which can varies the capacity of a pump by varying the working area of the vane portion of an impeller.

2. Prior Art

The cooling system for engines is generally provided with a water pump driven by the engine, for circulating water to cool a cylinder block and a cylinder head.

The conventional water pump of the above type has a pump impeller fixed to the end of a rotation shaft rotated by the engine, said pump impeller being constructed of a boss fix to the rotation shaft, a flange extending outward in a radial direction, and a vane formed on the flange. Consequently, such conventional water pump operates always with full capacity regardless of whether the engine is warmed up or cooled, and as the result, the power-loss of water pump becomes high and the operation efficiency becomes low.

A water pump for solving the above problem is disclosed in the Japanese Laid-open Utility Model Bulletin Jitsu-kai-sho No. 59-97295 (97295/1984). This water pump employs a structure such as shown in FIG. 11. In the figure, a rotation shaft 61 rotated by an engine (not illustrated) has pump impeller 62 fixed thereto and wax type thermostat 64 installed on the end of the rotation shaft 61. Also disk 65 is fixed to thrust shaft 64' which is axially movable by said thermostat 64. Compression spring 66 is installed between the base of the pump impeller 62 and the base of the disk 65. The pump impeller 62 is constructed of cylindrical boss section **62*a*, a flange section 62*b* which extends outwardly in the radial direction from said boss section 62*a*, a vane section 62*c* formed on said flange section 62*b*. The disk 65 has a cuplike recession formed at the center and has nearly the same cross sectional shape and radius as those of flange section 62*b* of the pump impeller 62. There are formed notches, to which vane section 62*c* of pump impeller 62 is fitted, in the circular portion of the disk 65** corresponding to the number of vanes.

When the temperature of the engine cooling water is relatively high, the thermostat 64 detects the temperature and moves the disk 65 fixed to the thrust shaft 64' leftward in the figure against spring 66. Consequently, the working area of vane section **62*c* of pump impeller 62 (area of the portion of the vane protruding from the notch of disk 65) increases and the working range of pump impeller 62 widens, resulting in increased flow rate of the pump. Conversely, when the temperature of the engine cooling water is relatively low, disk 65 moves rightward, the working area of the vane becomes smaller, and working range of pump impeller 62** narrows, resulting in decreased flow rate of the pump.

By the above-mentioned construction and operation, the water pump proposed in the Jitsu-kai-sho No. 59-97295 can make it possible to reduce the power-loss, increase the operation efficiency and reduce the fuel expense, as compared with the conventional water pump in which the pump impeller is only fixed to the rotation shaft, because it controls the water flow rate from the pump so as to make it correspond to the temperature variation by detecting the temperature of engine-cooling water. Still, this water pump has a problem to be solved, too. Namely, when it is necessary to lower the water flow rate of the water pump, the capability of pump impeller 62 should be reduced by moving the disk 65 rightward to narrow the working area of the vane. But, in the above situation, the cooling water flows in the direction to the flange **62*b* of pump impeller 62 through a gap between the cut portion of disk 65 and the pump impeller 62 and is disturbed in between the pump impeller 62 and the disk 65**. Consequently, the water flow rate of the pump and the power loss are not reduced to such extent as expected.

SUMMARY OF THE INVENTION

The object of the present invention is to provide a water pump which can vary the water flow rate of the pump according to a preset mode and reduce the power loss and fuel expense.

In accordance with the present invention, the water pump is constructed so that the flow rate of the pump is varied by a relative movement between the pump impeller and the disk in the axial direction. One surface of the pump impeller and one surface of the disk are faced with each other. At least one of the facing surfaces is provided with vanes, while another surface is provided with grooves of which the shape and the number are same as the vanes. The pump impeller and the disk are engaged each other and the distance in the axial direction of the rotation shaft between them is adjustable corresponding to the water temperature or the rotation speed of the rotation shaft.

The pump impeller and the disk rotate with the rotation shaft in the condition that, for example, the vanes formed on the pump impeller and the grooves formed on the disk are engaged each other. Under this situation, water flows in the space between the pump impeller and the disk through the inlet and flows out of the water pump by the action of the disclosed portion of said vanes. Therefore, the water flow rate of the water pump can be changed by varying the distance between the flange portion of the pump impeller and the edge of the disk, that is, by changing the engaging rate between the vanes and the grooves to change the area of disclosed portion of vanes. Thus, it becomes possible to control adequately the water flow rate of the water pump according to a preset mode. Moreover, it becomes possible to reduce the power loss and the fuel expense, as the rotation shaft is rotated always with adequate shaft-rotating power.

The foregoing and other objects, features and advantages of the present invention will be understood more clearly and fully from the following detailed description of preferred embodiments with reference to the attached drawings.

DETAILED DESCRIPTION OF PREFERRED EMBODIMENT

Figure 1:
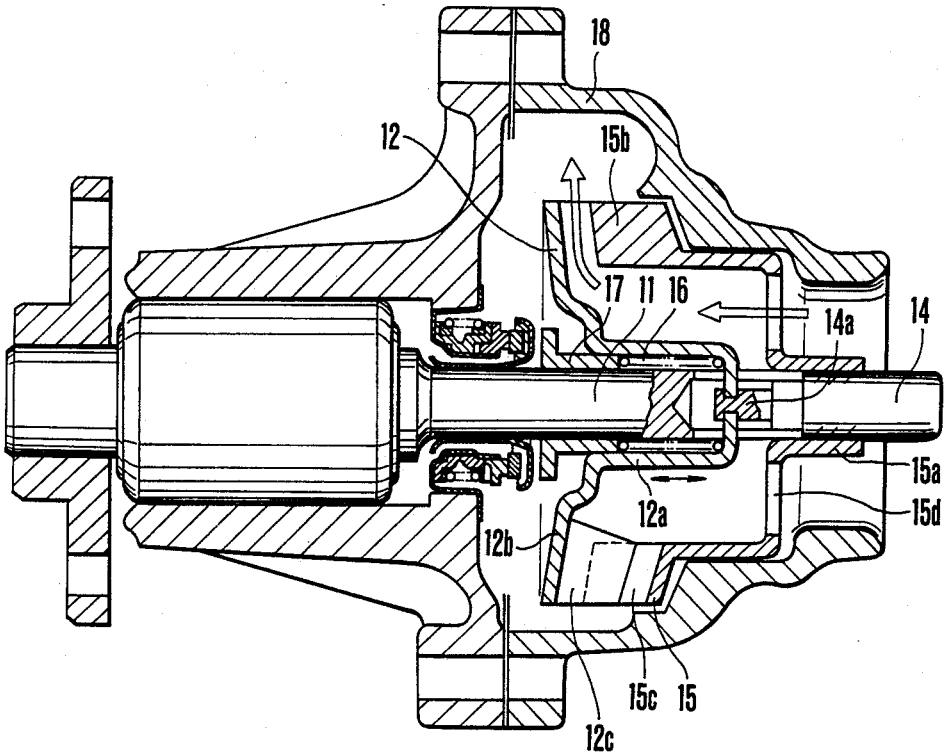
FIG. 1 shows a side sectional view of the water pump of one embodiment in accordance with the present invention.

Referring to FIG. 1, rotation shaft 11 which rotates upon receipt of the output of the engine (not illustrated), is installed in casing 18. On the end of the rotation shaft 11, wax type thermostat 14 is fixed in such a manner that thrust shaft 14*a* is disposed on the rotation shaft, and boss section 15*a* of disk 15 is fixed on the same end. Therefore, in this embodiment, disk 15 is rotated by rotation shaft 11, but does not move in the axial direction.

The boss section of pump impeller 12 is fixed on the end of the aforementioned thrust shaft 14*a* which is moved in the axial direction by the thermostat through the slit of rotation shaft 11. Therefore, pump impeller 11 rotates together with rotation shaft 11 and moves in the axial direction.

The numeral 17 is a stopper comprising a flanged cylindrical member which is fitted and fixed to rotation shaft 11. The retracting position of pump impeller 12 (shown at left in the figure) is controlled by the aforementioned flange of said stopper 17. Also compression spring 16 is disposed between one end of stopper 17 and boss section 12*a* of pump impeller 12.

Figure 2:
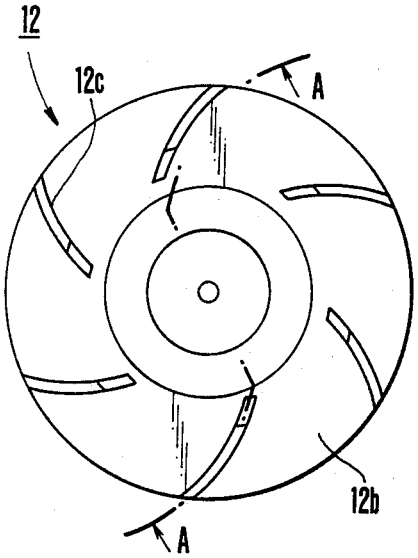
FIG. 2 shows a plan view from the vane side, of a pump impeller used for the water pump of FIG. 1.
Figure 3:
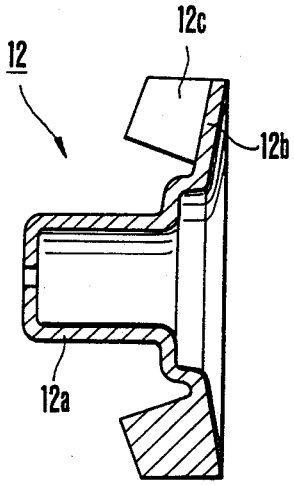
FIG. 3 shows a sectional view of the pump impeller of FIG. 2, on the line A—A.

FIG. 2 and FIG. 3 show pump impeller 12, which has cylindrical boss section 12*a* at the center. At the one end of pump impeller 12, a section to be fixed to thrust shaft 14*a* through the slit of rotation shaft is protruded in the radial direction. Another end of pump impeller 12 is formed as flange section 12*b*, of which middle portion is stepped. A large number of vanes 12*c* are installed uprightly in a radiant manner at a certain angle to the radial direction on the flat surface of the periphery of said flange section 12*b* on the boss section 12*a* side.

Figure 4:
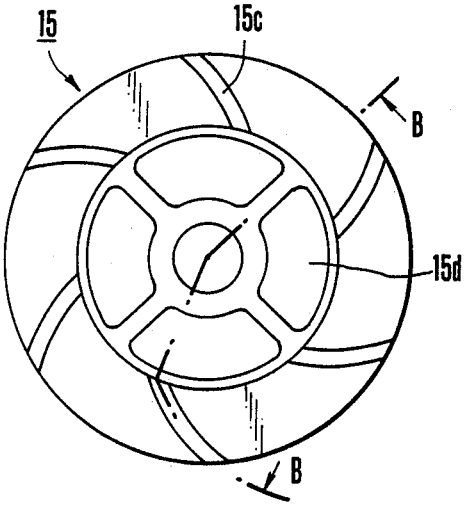
FIG. 4 shows a plan view from the groove side, of a disk used for the water pump of FIG. 1.
Figure 5:
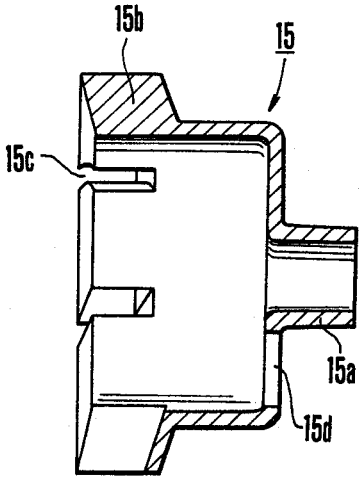
FIG. 5 shows a sectional view of the disk of FIG. 4, on the line B—B.

As shown in FIG. 4 and FIG. 5, disk 15 of a cuplike shape has boss section 15*a* and cooling water inlet port 15*d* which is formed in its bottom. Deep grooves 15*c* of the same number and the same shape as those of vanes 12*c* of the aforementioned pump impeller 12 are provided on the surface of a thick edge portion 15*b*.

Figure 6:
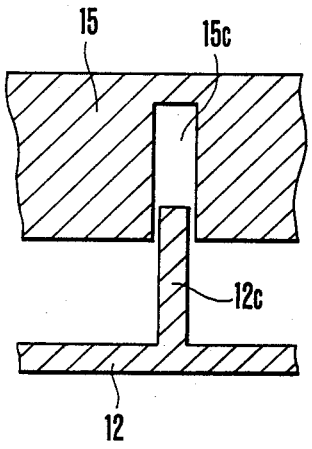
FIG. 6 shows a partial sectional view of the impeller and the disk engaged each other.

As shown in FIG. 1 and FIG. 6, vanes 12*c* of pump impeller 12 fit into grooves 15*c* of disk 15, and vanes 12*c* move back and forth in the aforementioned grooves 15*c* as thrust shaft 14*a* moves back and forth by sensing the water temperature through thermostat 14. When the temperature of the cooling water rises to a certain degree, thermostat 14 operates and pushes thrust shaft 14*a* leftward as shown in the figure. As thrust shaft 14*a* moves, pump impeller 12 also moves leftward as shown in the figure and vane 12*c* comes out of groove 15*c*. The arrow mark → in the figure indicates the direction of cooling water flow. As the area of the vane which acts upon the water in pump impeller 12 increases, the pump flow rate also increases. Therefore, as the cooling water temperature becomes higher, the exposed area of the aforementioned vane increases to increase the pump flow rate.

Conversely, when the cooling water temperature lowers to a certain degree, thermostat 14 senses the temperature and moves thrust shaft 14*a* rightward as shown in the figure, with the result that vane 12*c* gets deeply into groove 15*c* and the exposed area of vane 12*c* that is, the area that acts upon the water becomes smaller and, accordingly, the pump flow rate also decreases.

Thus the present embodiment changes the pump flow rate appropriately by the cooling water temperature and, at the same time, the shaft drive power copes with the temperature change, which is effective in reducing the fuel rate. Namely, during the warm-up operation of the engine, the cooling water temperature is low and the flow rate can be low, while, during the engine cooling cycle, the cooling water temperature rises, the working area of the vane increases and the pump flow rate increases. This makes it possible to perform the cooling operation to its full extent. Furthermore, since the vane wheel is constructed by enclosing it with pump impeller 12 and disk 15, the unnecessary stirring of water as in the prior art is eliminated and significant improvement of the pump efficiency is obtained.

Figure 7:
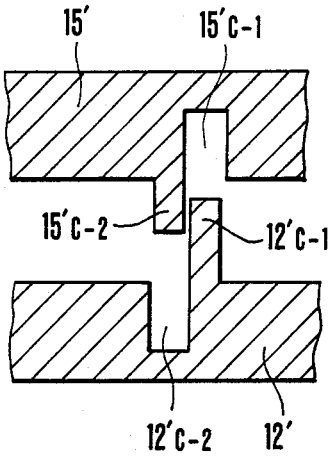
FIG. 7 shows another partial sectional view of the impeller and the disk engaged each other in a manner different from FIG. 6.

FIG. 7 shows an embodiment of which vane-groove fitting structure differs from that of the above-mentioned embodiment. Namely, in the embodiment of FIG. 6, vanes 12*c* are formed in pump impeller 12 and grooves 15*c* into which vanes 12*c* are fitted are formed in disk 15. But in the embodiment of FIG. 7, vanes 12′*c*-1 and 15′*c*-2 and grooves 12′*c*-2 and 15′*c*-1 are formed both in pump impeller 12′ and disk 15′ so that each fits to its mating part.

Figure 8:
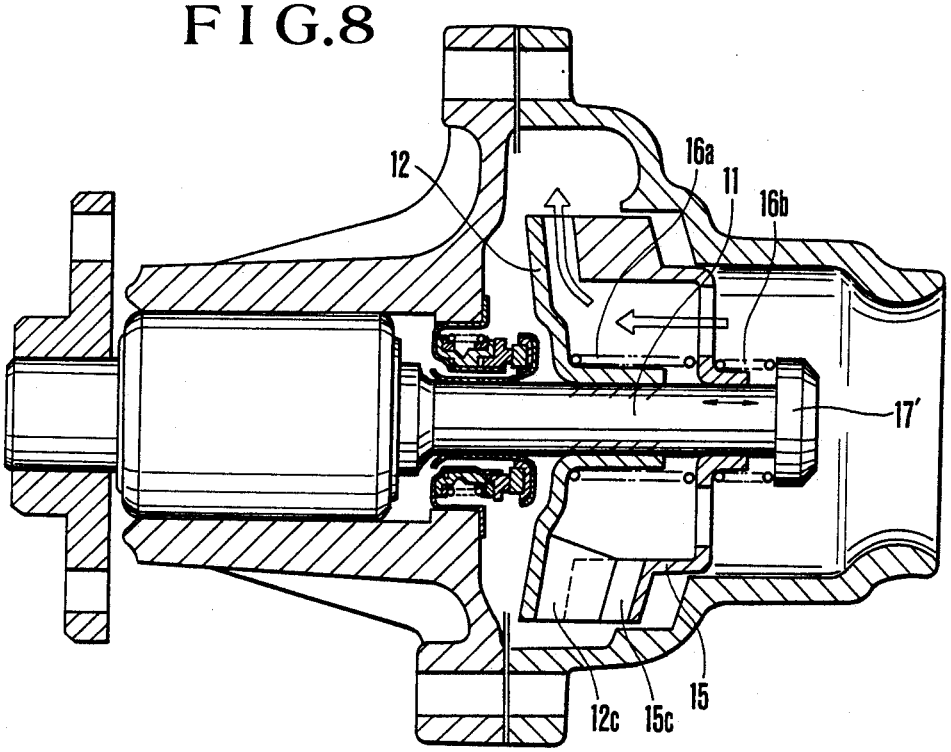
FIG. 8 shows a side sectional view of the water pump of the second embodiment in accordance with the present invention.

FIG. 8 shows the water pump of a second embodiment of the present invention. In this embodiment, the boss section of pump impeller 12 is fixed to rotation shaft 11 and the boss section of disk 15 is connected rotation shaft 11, for example, by means of spline, while disk 15 rotates together with rotation shaft 11 and is movable in the axial direction. The numeral 17′ is a stopper fixed to the end of rotation shaft 11. An ordinary compression spring 16*b* is installed between said stopper 17′ and the aforementioned disk 15. Furthermore, spring 16*a* made of shape-memory alloy is installed between the aforementioned pump impeller 12 and disk 15. Spring 16*b* is stronger than spring 16*a* made of shape-memory alloy at normal water temperature and, therefore, when the cooling water temperature is low, disk 15 moves leftward as shown in the figure, the working area of vane 12*c* becomes small, and the pump flow rate is held low. When the cooling water temperature rises the elasticity of spring 16*a* made of shape-memory alloy increases and moves disk 15 rightward as shown in the figure overwhelming the force of the other spring 16*b*. As a result, the working area of the vane increases and the pump flow rate increases.

Figure 9:
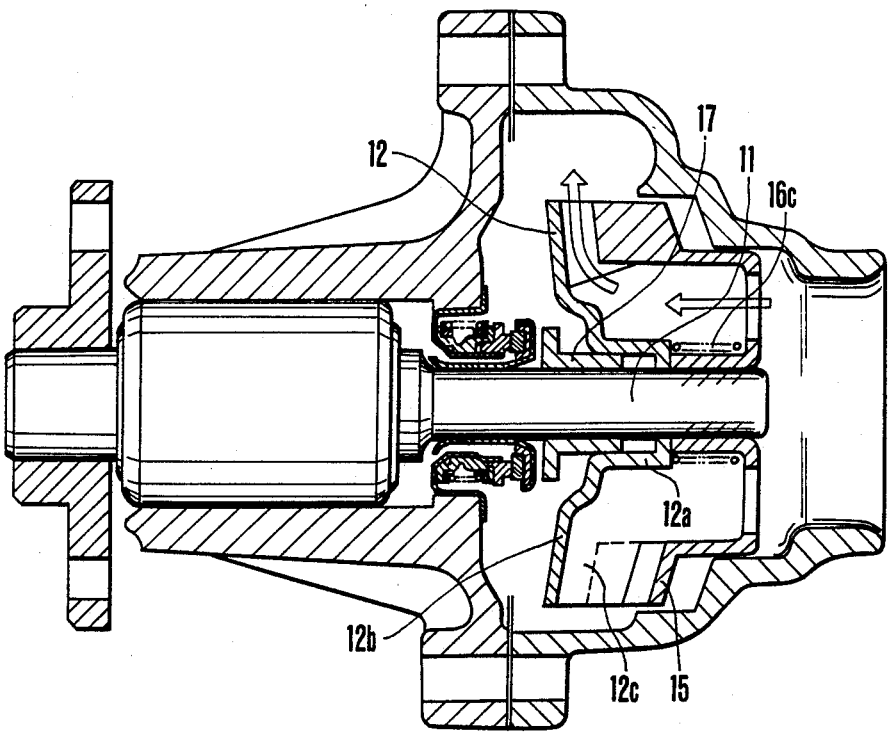
FIG. 9 shows a side sectional view of the water pump of the third embodiment in accordance with the present invention.
Figure 10:
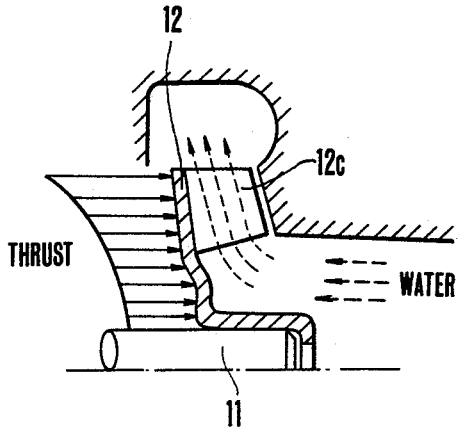
FIG. 10 shows a partial sectional view for mentioning the operation manner of the water pump of FIG. 9.
Figure 11:
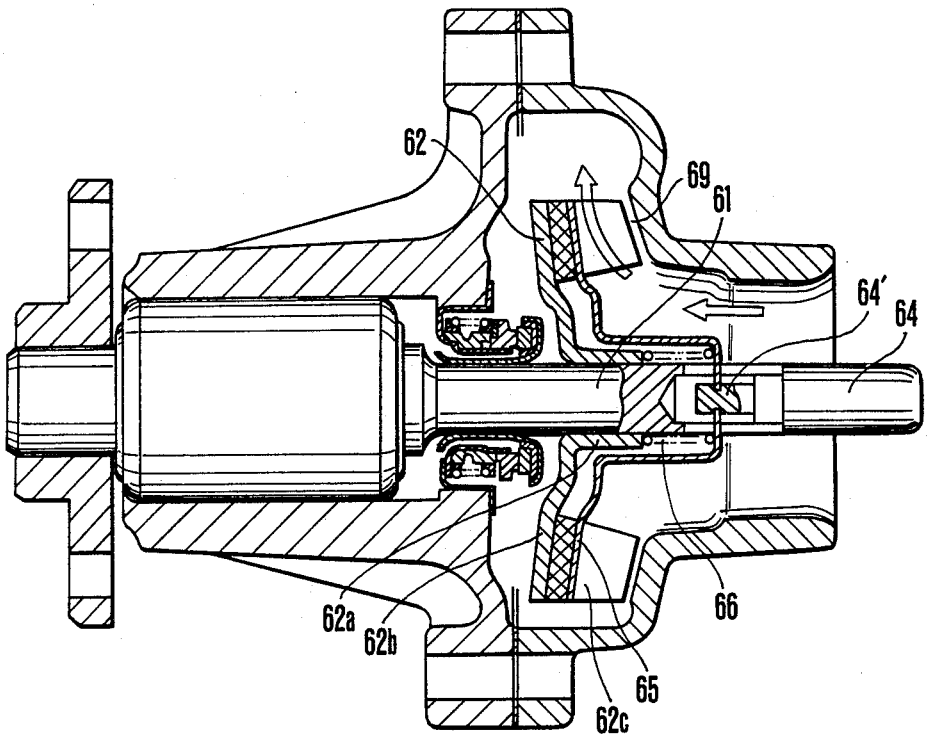
FIG. 11 shows a side sectional view of one of the conventional water pump.

FIG. 9 shows a third embodiment of the present invention. The water pump of this embodiment is intended to control the pump flow rate according to the change in the pump speed, that is, change in the rotational speed of the engine. The boss section of disk 15 is fixed to the end of rotation shaft 11 and compression spring 16*c* is installed between disk 15 and pump impeller 12, while notches that extend in the axial direction are formed in each boss section of disk 15 and pump impeller 12 so that the two are engaged and rotate together. The stopper 17 is a flanged cylindrical stopper. The inside surface of the boss section of pump impeller 12 is slidable on the outside surface of the cylinder of stopper 17 and its amount of movement is controlled by the flange of stopper 17. The pump impeller 12 is subject to an axial thrust in the direction shown by the solid-line arrow mark in FIG. 10 during rotation, and the magnitude of this force increases with increase in the rotational speed. Therefore, when the engine starts rotating at a high speed the axial thrust increases, and at a predetermined point, moves pump impeller 12 rightward as shown in the figure against the force of spring 16*c*. As a result, the working area of vane 12*c* decreases and the pump flow rate lowers.

In the case of this embodiment, its action is reverse to that in the first and second embodiments. But generally in the automobile engine cooling system, when the engine speed is low such as during idling, the wind amount is small and the pump flow rate which is proportional to the engine speed is low, so that the cooling performance is low. On the other hand, when the engine is rotating at a high speed, the wind amount and the pump flow rate increase, so that the cooling performance is usually high. For this reason, there is a margin in the cooling performance when the engine is rotating at a high speed because the water pump is designed based on the low speed operation of the engine.

This embodiment is intended to resolve the above problems and is intended to reduce the loss of power when the engine is rotating at a high speed by flowing water at the preset pump flow rate when the engine is rotating at a low speed and setting the pump flow rate at an optimum level at a high speed rotation of the engine when there is a margin in the cooling performance.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claim.

What is claimed is:

1. In a water pump for cooling an internal combustion engine comprising, a pump casing with a water inlet and a water outlet, a rotation shaft disposed in said pump casing and provided with a thermostat at an end portion, a thrust shaft incorporated in said rotation shaft and connected to said thermostat so as to be rotatable with said rotation shaft and slidable in an axial direction thereof, a pump impeller fixed to said thrust shaft, said pump impeller having a flange and a plurality of vanes extending in the axial direction of said rotation shaft from said flange, an improvement wherein:

the water pump is provided with a cup-like disk fixed to said rotation shaft and facing said pump impeller, said cup-like disk having a water inlet hole formed at a base portion of the cup-like shape and a plurality of grooves for receiving the vanes of said pump impeller, said pump impeller and said cup-like disk forming a space for water flow between them, the capacity of said space being variable with the motion of said pump impeller in the axial direction of said rotation shaft by the action of said thermostat so that the volume of water passing through said space is controlled according to the variation of water temperature.

* * * * *